US006761300B2

(12) United States Patent
Balma

(10) Patent No.: US 6,761,300 B2
(45) Date of Patent: Jul. 13, 2004

(54) STAPLER CONSTRUCTION

(76) Inventor: Giorgio Balma, P.O.B. 169, Voghera (PV) Viale della Repubblica, 13 (IT)

( * ) Notice: Subject to any disclaimer, the term of this patent is extended or adjusted under 35 U.S.C. 154(b) by 0 days.

(21) Appl. No.: 10/272,443

(22) Filed: Oct. 15, 2002

(65) Prior Publication Data

US 2003/0085251 A1 May 8, 2003

(30) Foreign Application Priority Data

Oct. 16, 2001 (IT) ..... MI20010549 U

(51) Int. Cl.[7] ..... B25C 5/02

(52) U.S. Cl. ..... 227/134; 227/120; 227/156; D8/50

(58) Field of Search ..... 227/134, 156, 227/120, 132; D8/50

(56) References Cited

U.S. PATENT DOCUMENTS

| | | | | | |
|---|---|---|---|---|---|
| 2,511,944 | A | * | 6/1950 | Richards | 227/128 |
| 3,640,443 | A | * | 2/1972 | Itagaki | 227/120 |
| 3,987,951 | A | * | 10/1976 | Thornhill | 227/120 |
| 4,014,493 | A | * | 3/1977 | Wolfe | 227/156 |
| 4,756,462 | A | * | 7/1988 | Ebihara | 227/120 |
| D394,194 | S | * | 5/1998 | Brunsdon et al. | D8/50 |
| 6,152,347 | A | * | 11/2000 | Wilson et al. | 227/134 |

* cited by examiner

*Primary Examiner*—Scott A. Smith
(74) *Attorney, Agent, or Firm*—Hedman & Costigan, P.C.

(57) ABSTRACT

A stapler comprises a loader device pivoted to a bottom plate and including the mechanisms for feeding the staples and operating the stapler, the loader device being, at least partially, engaged in a contoured handle body, the bottom plate being coupled to a bottom body so designed that the stapler can be used both as a gripper, by gripping the two bodies by a hand, and as a so-called table stapler, by causing the stapler to bear on a bottom plane.

2 Claims, 3 Drawing Sheets

STAPLER CONSTRUCTION

BACKGROUND OF THE INVENTION

The present invention relates to an improved stapler construction.

Are already known staples, of the so-called gripper type, comprising a loader pivoted to a plate thereby, by gripping by a hand the stapler as a gripper, it is possible to clamp the hand to operate the stapler and apply a staple.

Yet other prior staplers, the so-called table staplers, are conventionally use with staples having a size larger than that of the gripper stapler staples, and are designed to be operated in an ontable bearing condition, by operating the top movable portion of the stapler, comprising the stapler loader body.

The mentioned table staplers, of a less size, are preferred since they use staples having a size larger than those of the staples used in gripper staplers thereby allowing an operator to staple or stitch together larger thickness sheets.

However, the table staplers are specifically designed to be used in an on a table bearing condition and it is not possible to use them as a gripper stapler without a bearing surface.

SUMMARY OF THE INVENTION

Accordingly, the aim of the present invention is to provide a stapler construction which is improved with respect to like prior staplers.

Within the scope of the above mentioned aim, a main object of the present invention is to provide such a table stapler construction which can be easily used as a gripper stapler, without providing a bearing surface or table.

Another object of the present invention is to provide such a stapler construction which is more efficient in operation than prior staplers specifically designed for each specific stapling use.

According to one aspect of the present invention, the above mentioned aim and objects, as well as yet other objects, which will become more apparent hereinafter, are achieved by an improved stapler construction comprising a loader pivoted to a bottom plate and including operating mechanisms for supplying staples and operating the stapler, and being characterized in that said loader is engaged, at least partially, in a contoured handle body, said bottom plate is coupled to a bottom body so designed that said stapler construction can be used both as a gripper stapler, by gripping the two stapler bodies by a hand, and as a table stapler, by supporting a stapler body on a supporting surface.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative but not limitative example, in the accompanying drawings, where.

DESCRIPTION OF THE PREFERRED EMBODIMENTS

Figure 2:
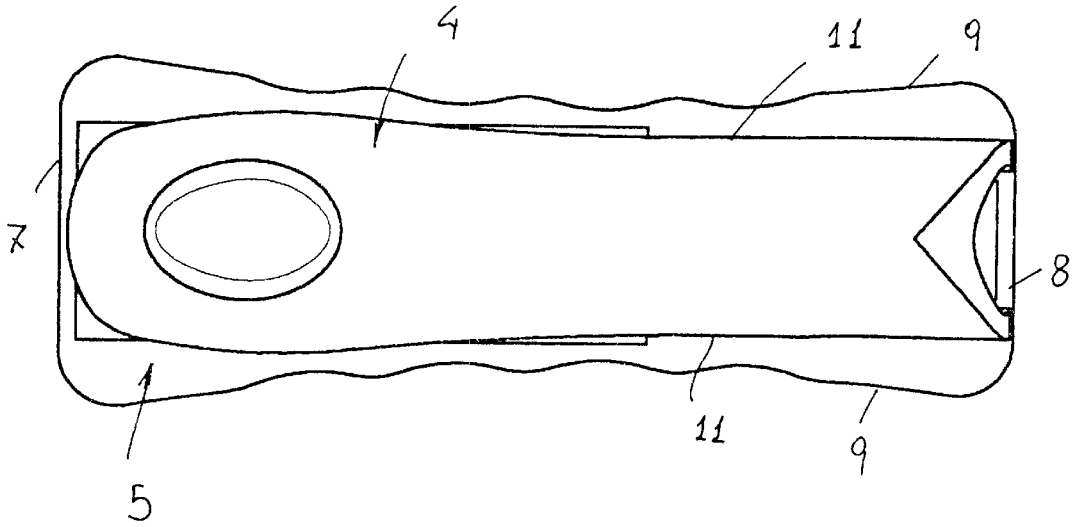
FIG. 2 is a top plan view of the stapler construction according to the invention.

With reference to the number references of the above mentioned figures, the stapler construction according to the invention, which had been generally indicated by the reference number 1, comprises a loader 2 pivoted to a substantially flat bottom plate 3, and including therein the required mechanisms for supplying the staples and operating the stapler, which mechanisms are well known per se and accordingly not herein further disclosed.

According to the invention, the loader 2 is engaged, at least partially, in a handle body 4, preferably made of a plastics material and having an anatomic configuration, to be easily gripped by a hand.

To this end, the bottom plate 3 is coupled to a bottom body 5.

The bottom body 5 is also preferably made of a plastics material and so contoured that it can be easily gripped by a hand, in order to operate the stapler as a gripper stapler.

Figure 1:
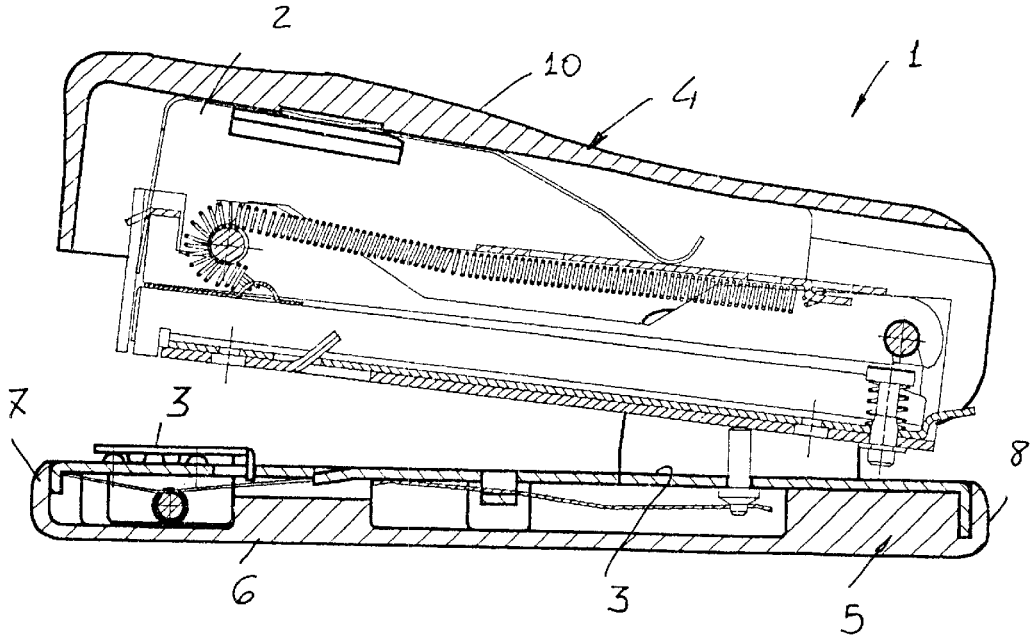
FIG. 1 is a side-elevation, cross-sectional view, of the improved stapler construction according to the present invention.
Figure 3:
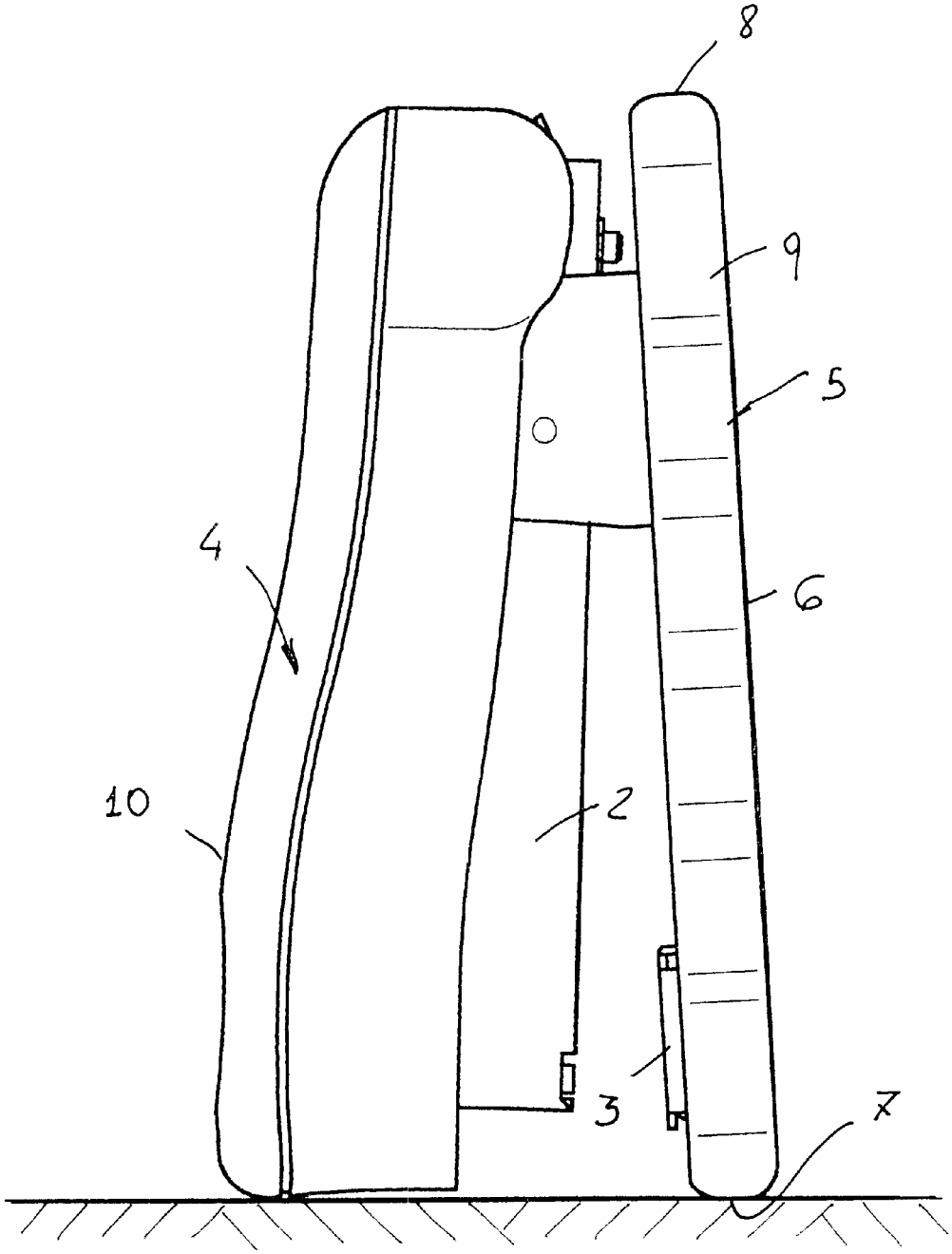
FIG. 3 is a further side elevation view illustrating the stapler according to the invention in a vertical position, bearing on a supporting plane or surface.
Figure 4:
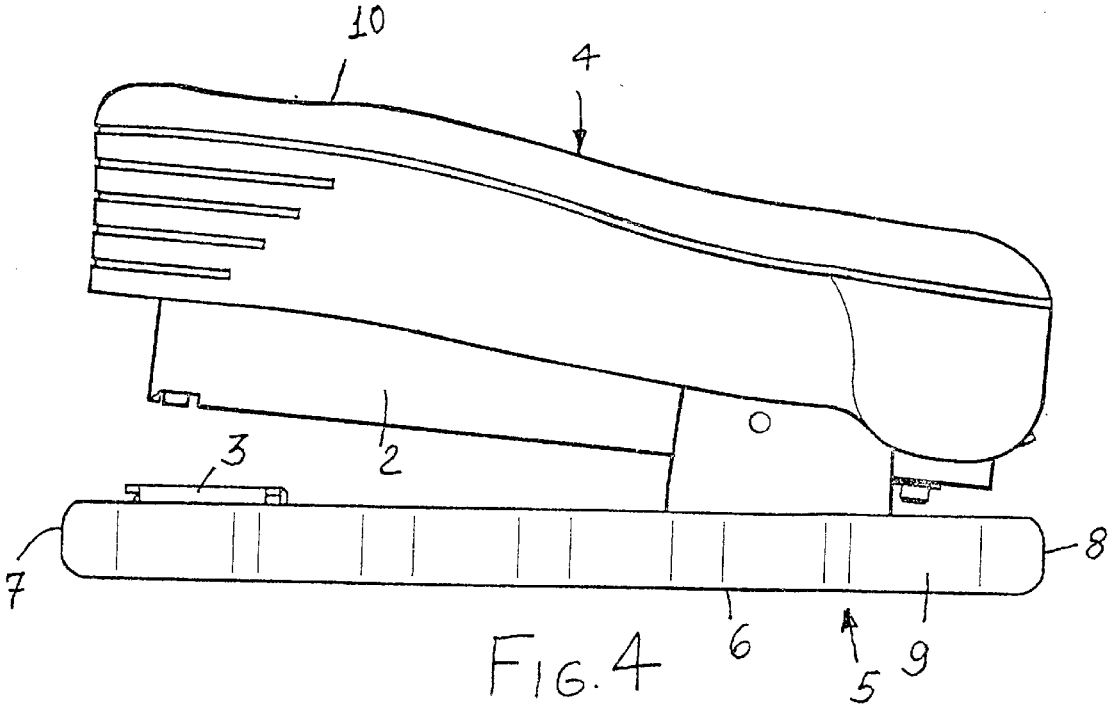
FIGS. 4 and 5 illustrate two further side views of two embodiments of the stapler construction according to the invention.

Both the handle body 4 and bottom body 5 are so designed that they allow to bear the stapler on a bearing surface both in a horizontal position, as shown in FIG. 1, and in a vertical position, as shown in FIG. 3.

To use the stapler according to the present invention both as a gripper stapler and a table stapler, the bodies 4 and 5 are, as stated, suitably shaped or contoured.

More specifically, the bottom body 5 is provided with a substantially flat bottom surface 6, merging with a front portion 7, defining an outer flat surface adapted to provide a stable bearing plane for the stapler in the vertical position of the latter, the front portion 7 having an inner flat surface tightly abutting against an end downward directed flat portion of the plate 3.

The bottom body 5 is moreover provided with a rear solid portion defining an outer surface 8, also of flat configuration, adapted to provide a further stable bearing plane for arranging the stapler in vertical position turned over with respect to the a further position shown in FIG. 3 said bottom plate 3 having another downward bent portion embedded in said rear solid portion of said bottom body 5.

Finally, the bottom body 5 comprises side surfaces 9 which have an anatomical configuration, i.e. they are undulated, thereby they can be used as a handle, for operating the stapler as a gripper stapler.

Figure 5:
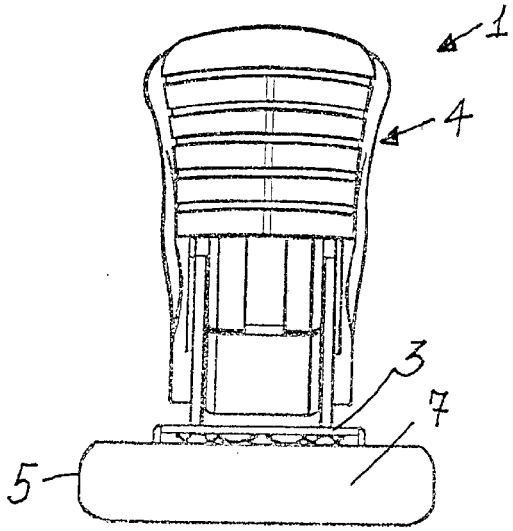

To that end, the handle body 4 comprises concave and convex merging side surfaces 11 (see FIG. 5) concave and convex and merging portions 10 on its top surface, facilitating the gripping by an operator, and allowing the stapler to be easily operated by pressure.

The thus designed stapler construction can be indifferently, and with the same efficiency, used as a table stapler, by bearing the bottom body on a bearing surface, and pressing by a hand on the handle body to operate the stapler, or as a gripper stapler, by gripping the stapler so as to allow the hand to encompass the handle body and bottom body to operate said stapler.

In a non use condition, the stapler can be supported on a table both horizontally, as is shown in FIG. 1, and vertically, as shown in FIG. 3, but even in a turned over condition.

By vertically supporting the stapler, a double advantage is obtained, since, in this position, it will be already ready to be gripped and operated without further handling operations.

Moreover, the stapler can be easily seen in a case of working surfaces supporting a plurality of articles and/or documents.

It has been found that the invention fully achieves the intended aim and objects.

In fact, the invention provides a stapler construction which is very flexible and efficient in operation, since it can be indifferently used either within or without a bearing surface.

In practicing the invention, the used materials, and their contingent size and shapes, can be any, depending on requirements and the status of the art.

What is claimed is:

1. An improved stapler comprising a loader pivoted to a substantially flat bottom plate and including operating mechanisms for supplying staples and operating the stapler, said loader being engaged, at least partially, in a contoured handle body with said bottom plate being embedded in a bottom body having a substantially flat bottom surface merging with a front end portion having an outer flat surface providing a stable bearing plane for arranging said stapler in a first vertical position, said bottom body being of a length that is substantially equal to said contoured handle, said front end portion having an inner flat surface tightly abutting against a front end portion of said bottom plate, said bottom body together with said contoured handle body having a rear solid portion having an outer flat surface providing a further stable bearing plane for arranging said stapler in a second vertical position with respect to said first vertical position, said rear solid portion of said bottom body having a flat portion of said bottom plate, said bottom body also comprising undulated hand gripping side surfaces.

2. A stapler according to claim 1, wherein said contoured handle body comprises convex and concave merging side surfaces and a concave and convex merging top surfaces.

* * * * *

UNITED STATES PATENT AND TRADEMARK OFFICE

CERTIFICATE OF CORRECTION

PATENT NO. : 6,761,300 B2
DATED : July 13, 2004
INVENTOR(S) : Giorgio Balma

It is certified that error appears in the above-identified patent and that said Letters Patent is hereby corrected as shown below:

Title page,
Item [76], Inventor, the residence should read:
-- Viala della Repubblica, 13
27058 Voghera, (Pavia) Italy --.

Signed and Sealed this

Thirteenth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,761,300 B2
APPLICATION NO. : 10/272443
DATED : July 13, 2004
INVENTOR(S) : Giorgio Balma It is certified that error appears in the above-identified patent and that said Letters Patent is hereby corrected as shown below:

Title page,
Item [76], Inventor, the residence should read:
-- Viala della Repubblica, 13
27058 Voghera, (Pavia) Italy --.

Signed and Sealed this

Fourth Day of July, 2006

JON W. DUDAS
*Director of the United States Patent and Trademark Office*